United States Patent [19]

Quehen

[11] 4,003,236

[45] Jan. 18, 1977

[54] PROCESS OF HOT CONTINUOUS ROLLING

[75] Inventor: André Quehen, Pontoise, France

[73] Assignee: SECIM, Courbevoie, France

[22] Filed: Feb. 23, 1976

[21] Appl. No.: 660,318

[30] Foreign Application Priority Data

Mar. 19, 1975 France ..... 75.08607

[52] U.S. Cl. ..... 72/366; 164/282

[51] Int. Cl.[2] ..... B21B 1/00

[58] Field of Search ..... 72/199, 234, 365, 366; 29/527.7; 164/282, 82

[56] References Cited

UNITED STATES PATENTS 3,710,841 1/1973 Baumann ..... 164/282

3,776,298 12/1973 Vogt ..... 164/282

*Primary Examiner*—Milton S. Mehr

[57] ABSTRACT

In a process of hot continuous rolling of an aluminium alloy blank formed by a continuous casting grooved wheel wherein the blank from the wheel is fed at the normal temperature for hot rolling between the cylinders of a train of two-cylinder stands, at least at the first stand the thickness H of the blank is reduced by a value ΔH satisfying the relationship $(h/a) \leq C$, where $h = H - (\Delta H/2)$, $a = \sqrt{R\Delta H}$, $R$ is the radius of the rolling cylinders and $C$ is a constant depending on the alloy.

3 Claims, 3 Drawing Figures

PROCESS OF HOT CONTINUOUS ROLLING

The present invention relates to improvements in the continuous hot rolling of an aluminium alloy blank produced by continuous casting in a grooved wheel.

Particularly in the manufacture of wire, a continuous production process including the continuous casting of a blank in a grooved wheel is often used. The groove in the wheel is partially closed by a metal strip and the metal cast inside the closed portion of the groove solidifies progressively to emerge as a solid blank when the metal strip exposes the groove. The blank is then immediately caught in a rolling train comprising successive grooved two-cylinder stands acting successively in different directions to reduce all the transverse dimensions of the blank.

The production of the blank by cooling of the metal in the groove inevitably leads to defects in the internal homogeneity of the blank, due, for example, to contraction cavities formed in the course of solidification, and expressed by porosity in the solid metal leaving the grooved wheel. To permit the production of fine wires of high mechanical quality, by first rolling the blank down to relatively small sections and then by wire-drawing, it is necessary to cause these internal defects to disappear. Such a lack of internal homogeneity would, in fact, lead to breakage of the wire in the final phases of wire-drawing, or would create regions of reduced mechanical strength in the finished wire which could lead to breakages in use.

The rolling of the blank, through the welding effect which it constitutes, is liable to cause such porosity to disappear by rewelding the walls under the effect of the stresses developed in the heart of the metal by the combined action of the temperature and of the local pressure.

Hitherto, however, it has not been possible, in the case of the grooved rolling of a long product, to define the rolling conditions to be adhered to in order that these stresses at the heart of the metal may be sufficiently high compression stresses to reclose and reweld completely the defects present in continuously cast blanks. It has even been observed that, on numerous existing rolling-mills, the reverse results are obtained, that is to say, after the first rolling pass, the porosity and internal defects in the blank are amplified. This is because the theory of rolling long products, such as bars, wires and sections, in grooves or between rollers is still in the field of research. No precise information has yet been published for the calculation of the internal stresses in this case. In contrast to what it has been possible to do in the rolling of sheet and of strip, it has not yet been possible, for rolling in grooves or between rollers, to define the geometrical conditions of a rolling pass which lead reliably to the closure of the internal defects in the blank.

The invention provides a solution to the above problem by defining a new parameter from the geometrical conditions of a rolling pass on a grooved rolling-mill and by specifying the limits of this parameter enabling the porosity, cracks, contraction cavities and other internal defects to be reclosed and rewelded completely.

According to the invention, there is provided a process of hot continuous rolling of an aluminium alloy blank from a continuous casting grooved wheel comprising feeding the blank at the normal temperature for hot rolling of the alloy between the cylinders of a plurality of pairs of cylinders, wherein at least at the first pair of cylinders the thickness H of the blank is reduced by passage between the cylinders by a value ΔH satisfying the relation $(h/a) \leq C$, where $h = H - \Delta H/2$ and $a = \sqrt{R\Delta H}$, $R$ being the radius of the rolling cylinders and $C$ being a constant depending on the nature of the alloy.

The invention will be better understood from the following description of embodiments thereof, given by way of example only with reference to the accompanying drawing.

The alloy used in the tests described below is an aluminium-magnesium-copper alloy designated AU4G under the French standard AFNOR A 02 001, or 2017 under the ASTM standards of the United States.

Figure 1:
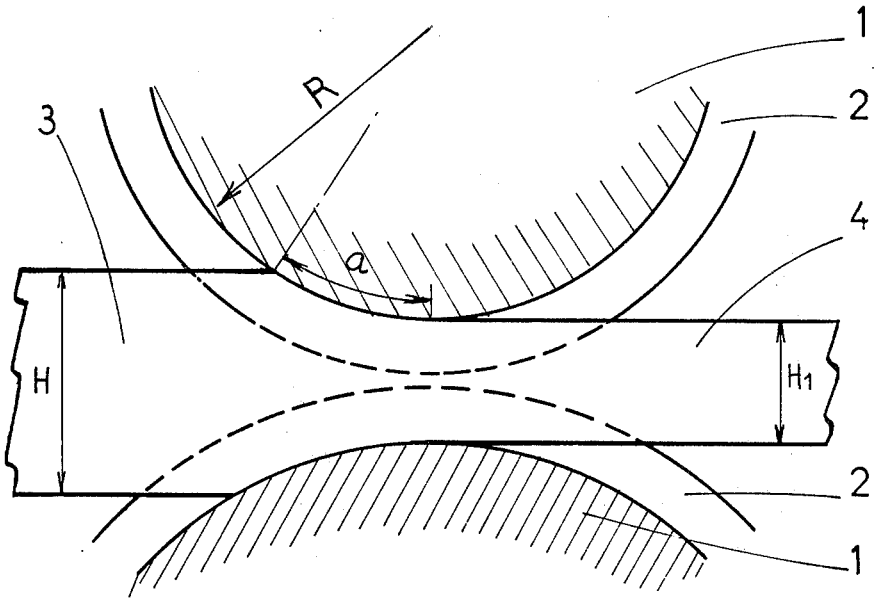
FIG. 1 illustrates diagrammatically a blank grasped by a pair of grooved cylinders.
Figure 2:
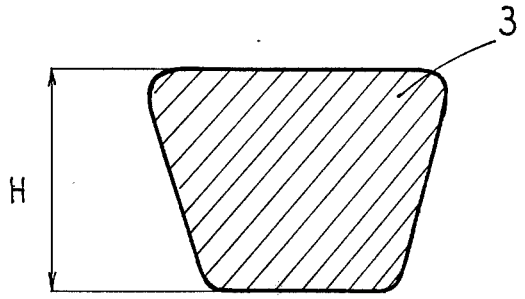
FIG. 2 shows the general shape of the section of the blank at the entrance to the cylinders.
Figure 3:
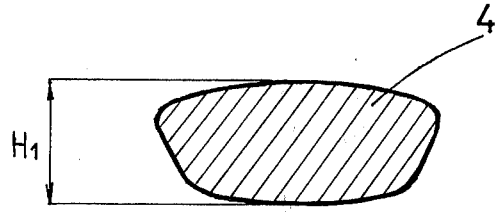
FIG. 3 shows the shape of the section on leaving the cylinders.

The tests were carried out on a conventional installation comprising a continuous casting grooved wheel immediately followed by a continuous rolling train for the blank, consisting of eight stands each with two grooved cylinders and of which the first stand is shown in FIG. 1. The rolling took place at the usual temperature for hot rolling of this type of alloy, namely 400° to 480° C. The cylinders 1 of the first stand each comprise a groove 2 with a diameter of 250 mm at the bottom of the groove. The blank 3 of height H leaving the casting wheel is converted into a blank 4 of height $H_1$ after passage between the cylinders.

Two simple parameters which were taken into consideration in the course of these tests were the mean value $h = (H + H_1/2)$ of the thickness of the product before and after rolling, and the length $a$ of the arc of contact of each cylinder with the blank. These parameters are connected in a simple manner both to the geometrical characteristics of the rolling-mill (radius R of the cylinder), and to the geometrical characteristics of the blank (initial thickness H and reduction in thickness ΔH).

In fact it is possible to write $h = H - \Delta H/2$ and $a = \sqrt{R\Delta H}$. It has been found possible to establish a limit C of the ratio $h/a$ such that by maintaining rolling conditions such that $h/a \leq C$, a total closing and rewelding of the internal defects of the cast blank are ensured. The following are the conditions of four tests:

| Test | Entry thickness H | Exit thickness $H_1$ | ΔH | $H = H - \frac{\Delta H}{2}$ | R | $a = \sqrt{R\Delta H}$ | $\frac{h}{a}$ |
|---|---|---|---|---|---|---|---|
| 1 | 28.5mm | 25mm | 3.5mm | 26.75mm | 125mm | 20.9mm | 1.3 |
| 2 | 28.5 | 23 | 5.5 | 27.75 | 125 | 26.2 | 1 |
| 3 | 28.5 | 21 | 7.5 | 24.75 | 125 | 30.6 | 0.8 |

-continued

| Test | Entry thickness H | Exit thickness $H_1$ | $\Delta H$ | $H = H - \frac{\Delta H}{2}$ | R | $a = \sqrt{R\Delta H}$ | $\frac{h}{a}$ |
|---|---|---|---|---|---|---|---|
| 4 | 28.5 | 19 | 9.5 | 23.75 | 125 | 34.5 | 0.7 |

The above table gives the rolling conditions and the corresponding ratio $h/a$ for each series of tests.

Checking by sweating of the internal quality of the blanks after the first stand revealed the presence of defects for the first three series of tests whereas the blanks obtained in the fourth series, with a ratio $h/a$ 0.7 were sound.

The tests enabled the value C to be determined for each usual alloy of aluminium. It has also been found that this limit C is, in fact, substantially the same for each of the alloys which can be included in the same class of the two classes of aluminium alloy already known, that is to say:

the slighly alloyed alloys or "soft" alloys, for which the limiting constant C can be taken as 0.9.

the heavily charged alloys or "hard" alloys, for which the limiting constant C may be taken as 0.7.

In every case it remains necessary to adhere, at the entrance to the stand, to a temperature situated within the usual range for hot rolling of the alloy in question.

It will be recalled that the class of soft aluminium alloys or those slightly alloyed includes the aluminiums of commercial purity by various names, and the alloys comprising various additions of magnesium or manganese not exceeding 2.5% by weight, or additions of silicon of less than 7%. Included for example in this class are the following alloys designated first by their reference according to the French standard AFNOR A 02 001 and, in brackets, by their equivalent reference, where it exists, according to the ASTM standards of the United States: AG2 — AM1 (3003) — AS5 (4043) — A5 (1060) — AGS (6063).

The class of hard or heavily charged alloys, on the other hand, includes the aluminium alloys comprising additions of one or more of the following elements: magnesium, copper, zinc, at least one of the additions being in the range of 2.5 to 5% for magnesium, 2 to 5% for copper, 5 to 8% for zinc; such alloys may also comprise other elements such as manganese, silicon, lead, bismuth, in small quantities. Included for example in this class are the following alloys designated as above: AG2.5 (5052) — AG4 (5086) — AG5 (5056) — AU4G (2017) — AU5PbBi (2011) — AZ5GU (7075).

The above described rolling conditions not only apply to the rolling in the first stand of the continuous train following the casting wheel but may also apply to the second stand and to the following stands. Adhering to the condition $h/a \leq C$ in the second stand further improves the elimination of the casting defects and renders it possible to obtain a perfectly compact metal after this second stand, on condition, of course, that the temperature is still within the appropriate range.

For the following stands, maintenance of the same limit of the ratio $h/a$ is recommended without it being so imperative. Actually, it is possible to accept ratios of $h/a$ slightly greater than C if the defects have been eliminated by the first two passes. If this had not been the case it would be more difficult to achieve this because there would be a risk of the temperature being too low.

Finally while the invention has been described in relation to rolling in two-high stands with grooved cylinders, it applies equally well to smooth cylinders, the radius R being taken externally for the smooth cylinders and at the bottom of the groove for grooved cylinders.

What is claimed is:

1. In a process of hot continuous rolling, by a train of two cylinder stands, of an aluminium alloy blank formed by a continuous casting grooved wheel, and at the normal temperature for hot rolling of the alloy, the improvement wherein at least at the first stand the thickness H of the blank is reduced by passage between the cylinders of the first stand by a value $\Delta H$ satisfying the relation $h/a \leq C$, where $h = H - \Delta H/2$ and $a = \leq R\Delta H$, $R$ being the radius of the rolling cylinders and $C$ being a constant depending on the nature of the alloy.

2. A process as claimed in claim 1, wherein the alloy is a soft or slightly alloyed alloy and the constant C is equal to 0.9.

3. A process as claimed in claim 1, wherein the alloy is a hard or heavily charged alloy and the constant C is equal to 0.7.

* * * * *